United States Patent [19]

Rowe

[11] 4,294,423

[45] Oct. 13, 1981

[54] SEALING MEANS FOR GUTTER HANGER FASTENING MEANS

[76] Inventor: Lacy A. Rowe, 1851 Skycoe Dr., Salem, Va. 24153

[21] Appl. No.: 128,727

[22] Filed: Mar. 10, 1980

[51] Int. Cl.[3] ..... E04D 13/06

[52] U.S. Cl. ..... 248/48.2; 52/95

[58] Field of Search ..... 248/48.1, 48.2; 52/11, 52/12, 95, 56, 90

[56] References Cited

U.S. PATENT DOCUMENTS

| | | | |
|---|---|---|---|
| 3,006,113 | 10/1961 | Barnes et al. | 52/95 X |
| 3,488,899 | 1/1970 | Schultz et al. | 52/95 X |
| 3,545,144 | 12/1970 | Sickler | 52/11 |
| 3,612,453 | 10/1971 | Zimmer | 248/48.2 |
| 3,726,051 | 4/1973 | Kellis | 52/11 |
| 3,909,905 | 10/1975 | Giordano | 52/12 X |
| 3,915,418 | 10/1975 | D'Amato | 248/48.2 |
| 3,981,107 | 9/1976 | Schubach | 52/90 X |

FOREIGN PATENT DOCUMENTS

| | | | |
|---|---|---|---|
| 967541 | 5/1975 | Canada | 248/48.2 |

*Primary Examiner*—J. Franklin Foss
*Attorney, Agent, or Firm*—Munson H. Lane, Sr.; Munson H. Lane, Jr.

[57] ABSTRACT

Gutter hangers with sealing means for fasteners such as nails, piercing the gutter rear wall and the facia board of a building. The sealing means may be of widely varied type, as for example, compressible grommets surrounding the nail in an eaves trough hanger as shown in U.S. Pat. No. 1,635,871 dated July 12, 1927, or may be in the form of a flexible compressible sealing strip positioned in the U-bend over the rear edge of the gutter shown in FIG. 3 of U.S. Pat. No. 3,416,760, Sauder, dated Dec. 17, 1968. The sealing means are preferably of compressible elastomeric material such as neoprene.

3 Claims, 6 Drawing Figures

SEALING MEANS FOR GUTTER HANGER FASTENING MEANS

BACKGROUND OF THE INVENTION

The invention relates to sealing means for water sealing around the rear nail hole of a gutter hanger or bracket attached to a side wall or a facia board of a building to prevent deterioration of the facia board. One type of hanger to which the present invention is applicable is illustrated in U.S. Pat. No. 1,635,871, and a second type of hanger to which a different form of sealing means is applicable is shown in U.S. Pat. No. 3,416,760.

The invention will be more readily understood by reference to the accompanying drawings and the following detailed description of the illustrative embodiments of the invention.

Figure 5:
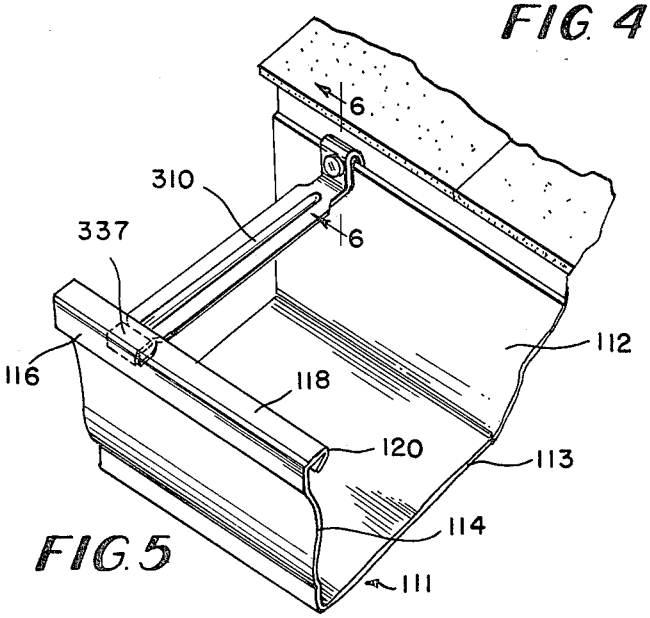
Figure 6:
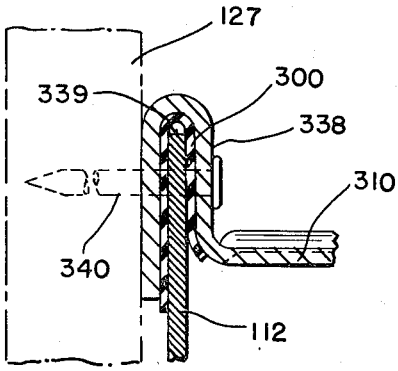

A modified form is shown in FIGS. 5 and 6.

FIG. 5 is a fragmentary perspective view of the modified sealing means applied to a gutter and bracket fastening means of the general type shown in U.S. Pat. No. 3,416,760.

FIG. 6 is a detail sectional view of the modification shown in FIG. 5, taken along the plane of line 6—6 of FIG. 5 wherein the sealing means is in a form of a U-shaped neoprene strip.

FIGS. 1-4

Figure 1:
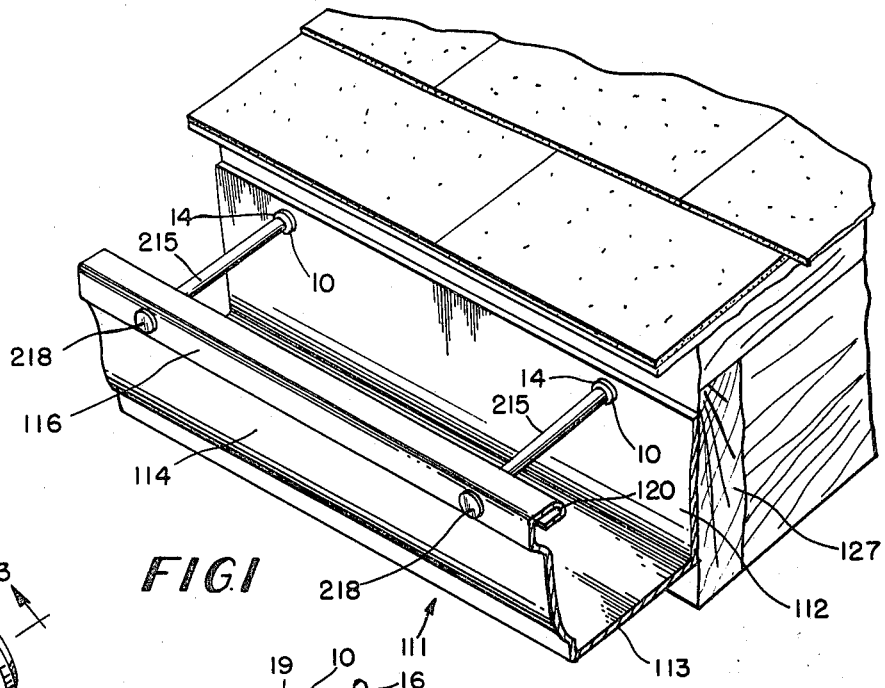
FIG. 1 is a fragmentary perspective view of a bracket fastener and gutter of the type shown in U.S. Pat. No. 1,635,871 with the fastener in installed position, and one form of my sealing means applied thereto, comprising a sealing grommet more fully shown in FIGS. 2, 3 and 4.

Referring first to the preferred form shown in FIGS. 1-4, FIG. 1 is a view along the lines of FIG. 1 of U.S. Pat. No. 3,416,760, as to the general arrangement of the gutter and facia board, to which the gutter is attached by suitable fastening means. However, instead of the bracket hanger fastening means of U.S. Pat. No. 3,416,760, fastening means 214 similar to the fastening means 14 shown in FIG. 3 of U.S. Pat. No. 1,635,871 is employed, comprising a nail enclosed in a tube or ferrule, wherein my improved sealing means 10, comprising a compressible grommet, generally designated by the reference numeral 10 is employed which is inserted within the ferrule and surrounding the nail as more fully shown in FIG. 4 of the present drawings.

Figure 2:
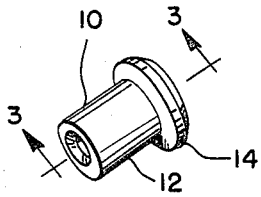
FIG. 2 is a perspective view of the sealing grommet.
Figure 3:
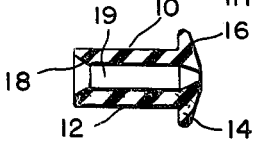
FIG. 3 is a longitudinal sectional view on line 3—3 of FIG. 2 showing the sealing grommet.

Grommet 10 is shown in detail in FIGS. 2 and 3 and is preferably formed of compressible elastomeric material such as neoprene or the like. The body of the grommet is generally cylindrical in form and includes a hollow tubular sleeve or body portion 12 adapted to snugly fit within one end of the ferrule surrounding the grommet. The grommet is provided with an end flange 14 which extends outwardly beyond the ferrule and is preferably provided with a frusto-conical or beveled face 16 to insure a tight fit in the rear wall of the gutter. The opposite end of the grommet from the flange 14 is preferably beveled at 18 to facilitate fitting over the nail which penetrates the facia board, to which the rain gutter is attached.

The details of the rain gutter and gutter fastening means are not my invention except as to the sealing means which is attached thereto, and the construction of the gutter, gutter fastening means and their application to the wall or facia board or building will be understood by those skilled in the art, particularly by reference to U.S. Pat. Nos. 3,416,760 and 1,635,871, supra. However, these related parts will be briefly referred to in this application so as to more fully set forth the relationship of the sealing means to these parts, the use of which sealing means constitutes the essence of my invention. The sealing means per se may be widely varied within the scope of my invention in its broadest aspects.

It will be understood that any required number of gutter hanger means including ferrules or tubes 215, fastening means 214 and elastomeric sealing means 10, may be employed with each gutter 111, two each being indicated in FIG. 1 of the present drawings and also FIG. 1 of Sauder U.S. Pat. No. 3,416,760, except that no sealing means is employed in U.S. Pat. No. 3,416,760.

Figure 4:
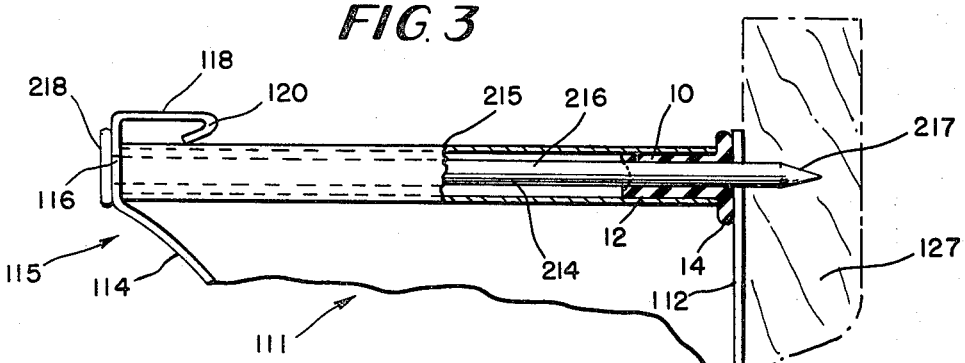
FIG. 4 is a detail view, partially in section and partially in elevation, showing the application of the sealing grommet to the ferrule or sleeve 15 of the fastener of U.S. Pat. No. 1,635,871.

Again referring to FIG. 1 of the present drawings and also to FIG. 1 of Sauder U.S. Pat. No. 3,416,760, the background features of the gutter and bracket hanger, which are old in the art and are shown in U.S. Pat. No. 3,416,760, will be referred to as far as applicable in the present drawings using the numeral 100 plus the corresponding numerals of U.S. Pat. No. 3,416,760 so that the relation of applicant's sealing means 10 to the background elements will be more clearly apparent. Similarly where certain features of the drawings of the present case (Rowe), and the drawings of Wilson U.S. Pat. No. 1,635,871 are common, the reference numeral 200 will be employed, plus the corresponding numeral of the Wilson patent, so that the relation between Rowe's sealing means (grommet 10) and the background material of the Wilson patent will be apparent, as best illustrated in FIG. 4 of Rowe's drawings as compared with FIG. 3 of the Wilson patent. Also to avoid confusion, the numeral 300 plus the corresponding numerals of the Sauder patent will be employed in describing the second embodiment shown in FIGS. 5 and 6 of the present case.

In FIG. 1 of the present drawings, the reference numeral 111 denotes a conventional rain gutter or channel having a rear wall 112, a bottom wall 113, and a front wall 114. The rear wall 112 of the gutter abuts a side wall portion or facia board of a building, at a position just below the eaves as also indicated in Sauder U.S. Pat. No. 3,416,760 and also in Wilson U.S. Pat. No. 1,635,871, to which latter patent further reference will be made hereinafter.

The gutter 111 is shown as secured to the wall portion of the building by means which includes an outer ferrule, sleeve or tube 215 biased between the upper portion of the rear wall 112 of the gutter and an upper vertical portion 116 of the front wall 114. The front wall 114 or the entire gutter 111 may be made of spring material so as to bias the ferrule 215 against the rear wall 112.

Suitable fastening means, herein shown as a headed nail 214 extends horizontally through an aperture in the front wall portion 116 of the gutter 111, then through the ferrule or tube 215 and then through an aperture in the rear wall 112 of the gutter 111 and thence into the wall portion or facia board 127 just below the eaves of a building, as also shown in Wilson U.S. Pat. No. 1,635,871.

The headed fastening means 214 may be in the form of a headed nail as shown at 14 in Wilson U.S. Pat. No. 1,635,871, or may be screw threaded as shown in fastener 26 in FIG. 3 of the Sauder U.S. Pat. No. 3,416,760. As shown in FIG. 4 of the present drawings, the fastening means includes an elongated body portion 216 which may be plain or screw threaded as desired, a sharpened end portion 217 and a headed portion 218. The term nail is intended to include either a plain or screw threaded fastener.

The above features, except for the sealing means 10 are, or may be, old in the art and are intended as background for the present improvement as previously stated. Prior art fastening means have proved unsatisfactory because water leaks around the nail hole as the nail enters the wall or facia board of the building at a point just below the eaves, causing the wall material to rot and deteriorate. This difficulty has been overvcome by my present invention, wherein suitable sealing means, composed of elastomeric material, is provided to prevent such leakage.

In accordance with the preferred embodiment of the invention, the sealing means comprises the elastomeric grommet 10 (FIGS. 2 & 3) which is inserted within one end of the ferrule or tube 215 (FIGS. 1 and 4) with the flange portion 14 projecting therefrom. Thereafter the ferrule or tube 215 with the sealing means 10 inserted in one end thereof, is applied to the gutter 111 between a vertical web portion 116 of the front wall 114 of the gutter and the upper portion of the rear wall 112 of the gutter. The front gutter wall 114 is sufficiently resilient, or is resiliently biased, so that when the ferrule 215 is inserted therein and a headed nail 114 applied, the ferrule 215 will be urged against the projecting flange 14 of the grommet 10 with sufficient force to cause the elastomeric material of which the grommet 10 is composed to provide a fluid tight fit about the rear wall nail hole and thus prevent deterioration of the facia board as previously set forth.

As will be understood by those skilled in the art, the details of the gutter fastening means and sealing means may be widely varied without departing from the spirit of the invention in its broadest aspect.

Embodiments shown in FIGS. 5 and 6

In FIGS. 5 and 6, another illustrative embodiment of the invention is disclosed. Sealing means, generally designated by the reference numeral 300, in the form of a strip of flexible compressible elastomeric material, such as neoprene, is preferably employed, and is shown in connection with the general form of gutter and gutter fastening bracket of Sauder U.S. Pat. No. 3,416,760.

In FIG. 5 of the present drawings, a gutter 111 is shown corresponding to the gutter 111 shown in FIG. 1 of the present drawings, and the same reference numerals will be employed as in FIG. 1 as far as applicable to the gutter. A bracket hanger 310 is shown which may be similar to the bracket hanger 10 of Sauder U.S. Pat. No. 3,416,760, but need not include all refinements shown in such patent. Consequently only the principal features of the bracket hanger will be referred to herein and new reference numerals will be employed for other features.

Since FIG. 6 is a section on line 6—6 of FIG. 5, the same reference numerals will be employed as in FIG. 5.

As shown in FIG. 5, the reference numeral 111 denotes generally a rain gutter of resilient flexible material such as sheet metal, as in FIG. 1. Said gutter 111 includes a rear wall portion 112 adapted to be attached to a facia board 127 of a building just below the eaves thereof, a bottom portion 113, and a front wall portion 114 shaped into channel form 115, including a vertical upper web portion 116 from which extends a horizontal portion 118, terminating in a hook portion 120 by which a bracket may be sustained by any suitable means as shown for example, in Sauder U.S. Pat. No. 3,416,760.

As shown in FIGS. 1 and 5 of the present drawings, a bracket hanger herein designated 310 is interposed between the walls 112 and 114 of the gutter 111, said bracket hanger 310 having a hook portion 337 at one end thereof, which is adapted to engage the hook portion 120 of the front wall of the gutter 111 (see also FIGS. 1, 3 and 4 of Sauder U.S. Pat. No. 3,416,760 for a similar construction).

The opposite end of the bracket hanger 310 from the hook end 337 which engages the hook portion 120 of the front wall 114, is provided with a vertical inverted U-shaped hook portion 338 which is designated to fit over the apertured upper edge portion 339 of the rear gutter wall 112. The inverted U-shaped bend 338 is provided with horizontally aligned openings (not shown) through which a headed nail or other fastening means 340 is inserted and driven into the wall or facia board of a building to which the gutter 111 is applied. I have found that by the use of a sealing member 300, as shown in FIG. 6, in a form of a strip of compressible elastomeric material such as neoprene, inserted within the inverted U-shaped bend 338 and extending over the apertured upper edge 339 of the rear wall 112 of the gutter 111, leakage about the rear wall nail hole is avoided, and deterioration of the facia board is prevented. The sealer 300 covers the full inside area of the inverted U-shaped bend 338 of the hanger 310 and may be applied to the hanger by means of a suitable adhesive such as epoxy resin.

It will be understood that, as in the embodiment shown in FIGS. 1–4, any desired number of bracket hanger means 310 and fastening means 340 equiped with sealing means 300 may be employed, two such units being illustrated in FIG. 1 of the present drawings, and in FIG. 1 of Sauder U.S. Pat. No. 3,416,760.

The invention has been described in detail for the purpose of illustration, but it will be obvious to those skilled in the art that numerous modifications and variations may be resorted to without departing from the invention in its broadest aspects.

For example, the gutter and gutter fastening means shown in Sauder U.S. Pat. No. 3,416,760 and in Wilson U.S. Pat. No. 1,635,871, and in many details shown by way of illustration, may be varied if desired. Also *nails* have been referred to herein as the fastening means but any elongated headed fastening means, pointed or sharpened at one end to facilitate entry into the wall of the building or facia board may be employed. The elongated body of the fastening means may be threaded if desired, and the head may be shaped to receive a suitable wrench or screwdriver. Also various parts through which the fastening means are driven have been described as having perforations or openings therein. These openings are preferably preformed, but if desired, may be formed as the point of the fastening means penetrates the parts.

What is claimed is:

1. Gutter wall fasterner nail hole sealing means for use with a rain gutter having a rear wall portion adapted to be secured to a facia board or wall of a building, fastening means for securing the gutter to the building wall, including a headed nail or like headed and sharpened fastening means adapted to be driven through a hole in the rear wall of the gutter and into the facia board; said sealing means comprising compressible elastomeric material adapted to be compressed about the rear gutter wall nail hole, when the nail is driven through the rear gutter wall into the facia board whereby the facia board is protected against deterioration due to leakage of water about the rear gutter wall nail hole, said gutter including a front wall spaced from the rear gutter wall, said front and rear walls having apertures through which said sharpened fastening means is adapted to be driven to secure the gutter to a facia board; a fastener receiving tube or ferrule interposed between the apertures in said front and rear walls of the gutter, said sealing means comprising a compressible grommet of elastomeric material having a body portion adapted to fit within one end of said fastener receiving tube or ferrule, said grommet body portion having a passage there through coaxial with the outer tube or ferrule when the body of the grommet is inserted therein, through which passage in the body of the grommet said sharpened fastening means is adapted to be driven, compressible means at one end of the grommet projecting beyond the ferrule and extending between the end of the ferrule and the gutter rear wall, said compressible means being adapted to be compressed when the fastener is driven into the facia board.

2. Gutter wall fastener nail hole sealing means as defined in claim 1 wherein the compressible elastomeric material comprises neoprene.

3. The gutter wall fastener nail hole sealing means as defined in claim 1 wherein said compressible means at one end of the grommet comprises a flange.

* * * * *